US008362999B2

(12) United States Patent
Huang et al.

(10) Patent No.: US 8,362,999 B2
(45) Date of Patent: Jan. 29, 2013

(54) LIQUID CRYSTAL DISPLAY WITH ENABLING PULSES

(75) Inventors: Hsueh-Ying Huang, Hsin-Chu (TW); Min-Feng Chiang, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 988 days.

(21) Appl. No.: 12/149,705

(22) Filed: May 7, 2008

(65) Prior Publication Data

US 2009/0085860 A1 Apr. 2, 2009

(30) Foreign Application Priority Data

Sep. 28, 2007 (TW) ..... 96136401 A

(51) Int. Cl.
*G09G 3/36* (2006.01)

(52) U.S. Cl. ..... 345/100; 345/102

(58) Field of Classification Search ..... 345/87, 345/102, 100; 349/61–70; 362/561
See application file for complete search history.

(56) References Cited

U.S. PATENT DOCUMENTS

| | | | | |
|---|---|---|---|---|
| 5,724,057 | A * | 3/1998 | Kimura et al. | 345/89 |
| 5,796,380 | A | 8/1998 | Kurematsu et al. | |
| 5,859,627 | A * | 1/1999 | Hoshiya et al. | 345/100 |
| 6,456,268 | B1 | 9/2002 | Takeda | |
| 7,710,377 | B2 | 5/2010 | Kang et al. | |
| 2002/0196220 | A1 * | 12/2002 | Sato et al. | 345/87 |
| 2003/0058229 | A1 * | 3/2003 | Kawabe et al. | 345/204 |
| 2004/0066363 | A1 * | 4/2004 | Yamano et al. | 345/98 |
| 2004/0263459 | A1 | 12/2004 | Yang | |
| 2005/0174310 | A1 | 8/2005 | Huang et al. | |
| 2006/0097981 | A1 | 5/2006 | Park et al. | |
| 2006/0187176 | A1 | 8/2006 | Yang | |

FOREIGN PATENT DOCUMENTS

| | | |
|---|---|---|
| CN | 1556519 | 12/2004 |
| CN | 1773338 | 5/2006 |
| TW | 521244 B | 2/2003 |
| TW | 200603071 | 1/2006 |
| TW | 200630951 | 9/2006 |

* cited by examiner

*Primary Examiner* — Chanh Nguyen
*Assistant Examiner* — Ram Mistry
(74) *Attorney, Agent, or Firm* — Rabin & Berdo, P.C.

(57) ABSTRACT

In a method for driving a liquid crystal display, a plurality of first enabling pulses are transmitted to a first group of scan lines in a first period of a predetermined time, respectively. A plurality of second enabling pulses are transmitted to a second group of scan lines in a second period of the predetermined time, respectively. The pixel voltages of pixel units, which are connected to the scan lines of the first and second group, are different in their polarities. During the predetermined time, a common voltage signal, which has different levels in the first and second period, is transmitted to the common line. A liquid crystal display applying the above driving method is also disclosed.

16 Claims, 6 Drawing Sheets

LIQUID CRYSTAL DISPLAY WITH ENABLING PULSES

RELATED APPLICATIONS

This application claims priority to Taiwan Patent Application Serial Number 96136401, filed Sep. 28, 2007, which is herein incorporated by reference.

FIELD OF THE INVENTION

The invention is related to a display and a driving method thereof, more particularly, to a LCD display and a driving method thereof.

BACKGROUND OF THE INVENTION

FIG. 1 is a timing chart of signals for the line inversion method adopted by the conventional liquid crystal display. FIG. 1 shows that, for all the scan lines, the polarities of voltages applied to the data lines and the common lines are repeatedly inverted with time in the liquid crystal display driven by a color sequential method. In the color sequential method, sub-frames of three primary colors, e.g., red, green, and blue, are configured to constitute a complete frame, and thus the driving frequency of each sub-frame is 180 Hz. However, the scan lines on the panel of the LCD display are switched in only a small portion of a sub-frame time (<5 μs), and the other portion of the sub-frame time is configured to rotate the liquid crystal molecules in specific positions to turn on a backlight. Moreover, a scan time of a scan line needs to be shortened in order to reduce the possibility of the liquid crystal molecules reacting synchronically as a result of differences between the scan times of different scan lines, which leads to the degradation of brightness of the display panel driven by a line-sequential mode. Therefore, the scan time for each scan line must be shortened.

In the condition that the above scanning method is adopted by a driving configuration of the common line voltage swing shown in FIG. 1, and the LCD display is operated by a line inversion method, a common voltage on the common lines may be incapable of inverting with time and thus resulting in the problem of unstable charging of a pixel unit.

For solving the aforesaid problems, in general, the LCD display in FIG. 1 is substituted by an LCD adopted with a frame inversion method. FIG. 2 is a timing chart of the signals of the frame inversion method adopted by a conventional LCD. FIG. 2 shows when the LCD is driven by the color sequential method, the voltages on the scan lines, data lines, and common lines vary with time. As shown in FIG. 2, in the frame inversion method, the polarity of a common line voltage inverses once between two consecutive frames such that the common line voltage reaches a stable value before the scan line start being switched on, and thus the stability of charging state of the pixel unit is ensured.

However, compared with other LCDs, the flicker problem of the LCD with the frame inversion method is more serious. The LCD implementing a frequency of up to 300 Hz may mitigate the flicker problem. If the reaction time of the liquid crystal molecules can't keep up with the frequency, brightness degradation is inevitable.

For solving the aforesaid problem, an LCD and a driving method thereof are provided.

SUMMARY OF THE INVENTION

One aspect of the invention is to provide a driving method for the LCD. In a first period of a predetermined time, a plurality of first enabling pulses are transmitted to a first group of scan lines during a first period of a predetermined time, respectively. A plurality of second enabling pulses are transmitted to a second group of scan lines during a second period of the predetermined time, respectively. The pixel voltages of pixel units, which are connected to the scan lines of the first and second groups, are different in their polarities. During the predetermined time, a common voltage signal, which has different levels in the first and second period, is transmitted to the common line.

Another aspect of the invention is to provide an LCD, which includes a plurality of pixel units, a plurality of scan lines, at least one scan driver and a plurality of common lines. Each of scan lines is respectively connected to one of terminals of a row of pixel units. The scan lines are divided into a first group and a second group. The pixel voltages of the pixels, which separately connected to the first and second groups, are different in their polarities. In a first period of a predetermined time, a plurality of first enabling pulses are transmitted to a first group of scan lines in a first period of a predetermined time, respectively. A plurality of second enabling pulses are transmitted to a second group of scan lines in a second period of the predetermined time, respectively. Each common line is respectively connected to other terminals of the row of the pixels. Also, a common voltage signal on a common line is different in polarity during the first and second period.

DETAILED DESCRIPTION OF THE PREFERRED EMBODIMENT

Figure 1:
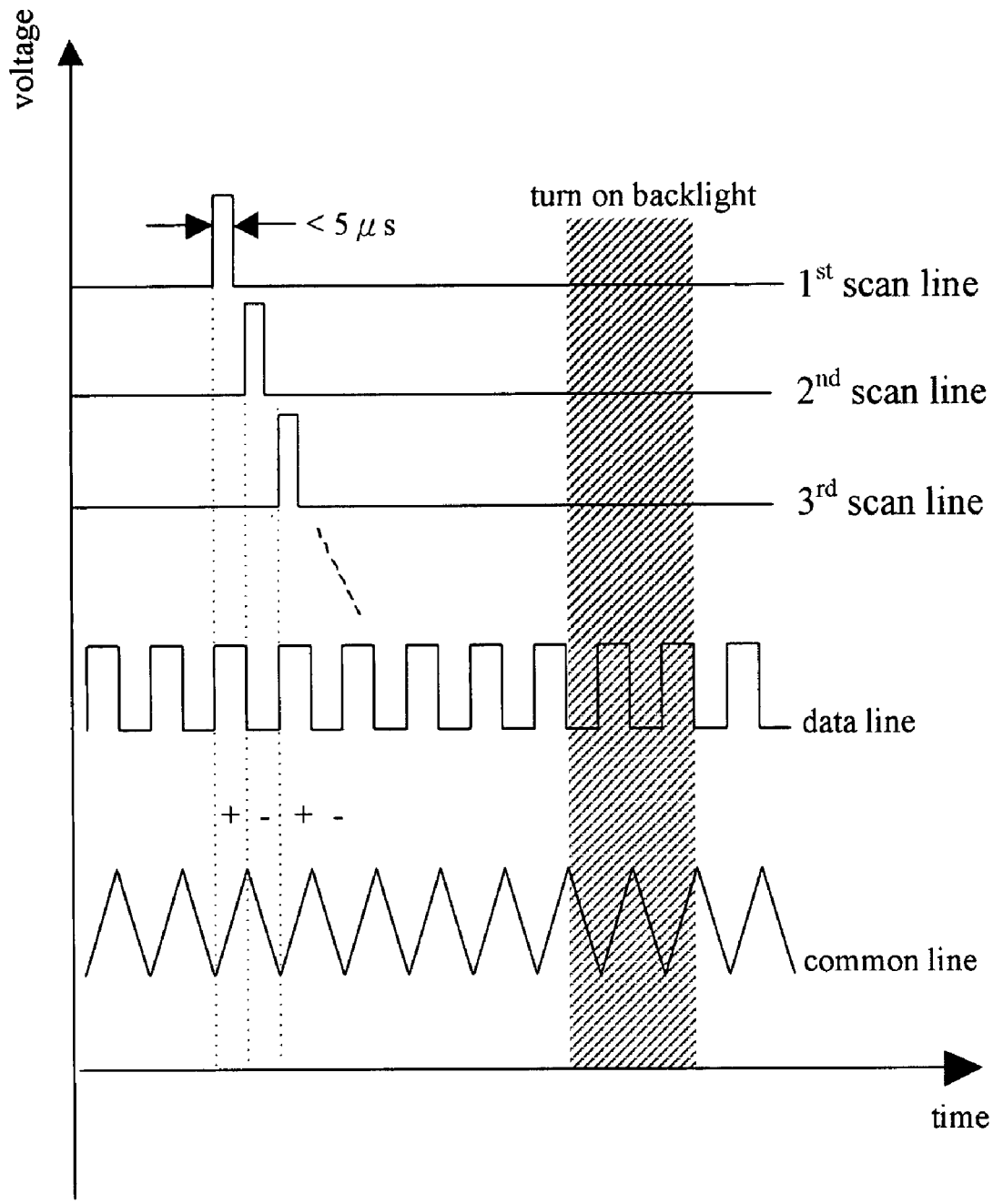
Figure 1 (Prior Art)
FIG. 1 is a timing chart of signals of a conventional LCD with a line inversion method.
Figure 2:
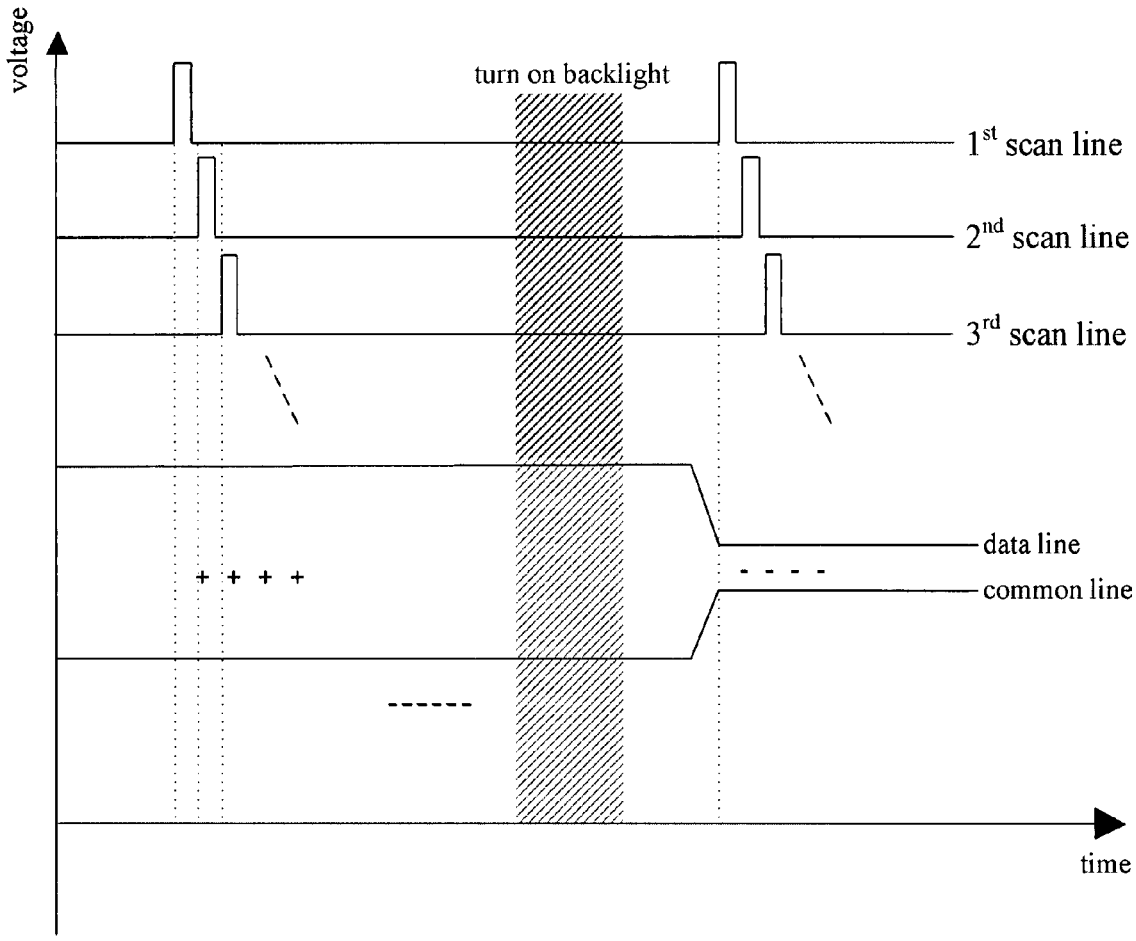
Figure 2 (Prior Art)
FIG. 2 is a timing chart of signals of a conventional LCD with a frame inversion method.
Figure 3:
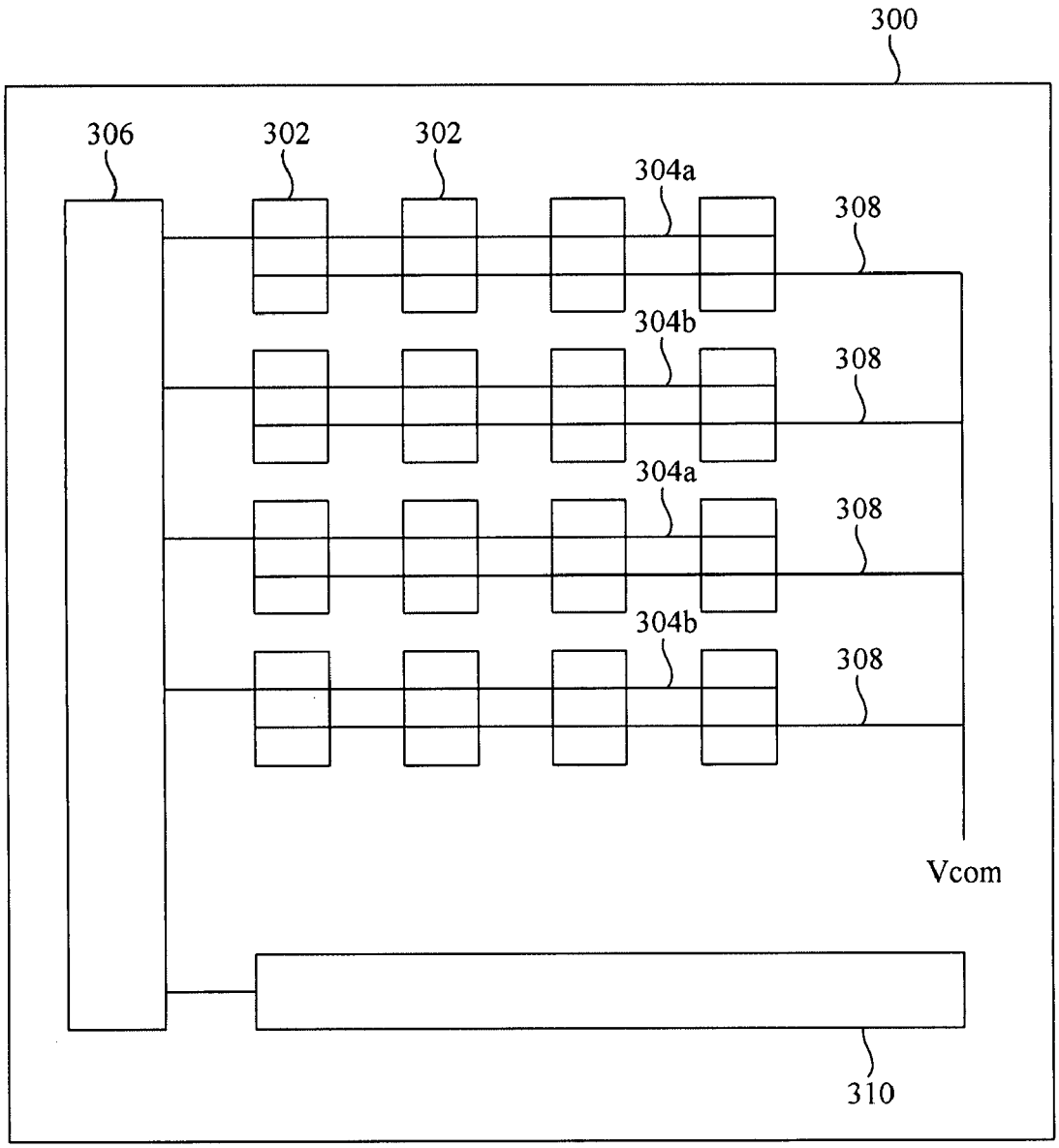
FIG. 3 is a schematic diagram illustrating an LCD according to an embodiment of the invention.

FIG. 3 is a schematic diagram illustrating an LCD according to an embodiment of the invention. LCD 300 includes a plurality of pixel units 302, a plurality of scan line 304*a* and 304*b*, at least one scan driver 306 and a plurality of common lines. Each of scan lines 304*a* or 304*b* is respectively connected to a terminal of a row of pixel units. The pixel voltages of the pixel unit 302 connected to first group of scan lines 304*a*, and the pixel voltages the pixel unit 302 connected to the second group of scan lines 304*b* are different in their polarities.

The scan driver 306 is configured to output a plurality of first enabling pluses to the first group of scan lines in a first period of a predetermined time, and output a plurality of second enabling pluses to the second group of scan lines 304*b*. A common voltage signal on each of the common lines 308 is different in polarity during the first and second period.

Figure 4:
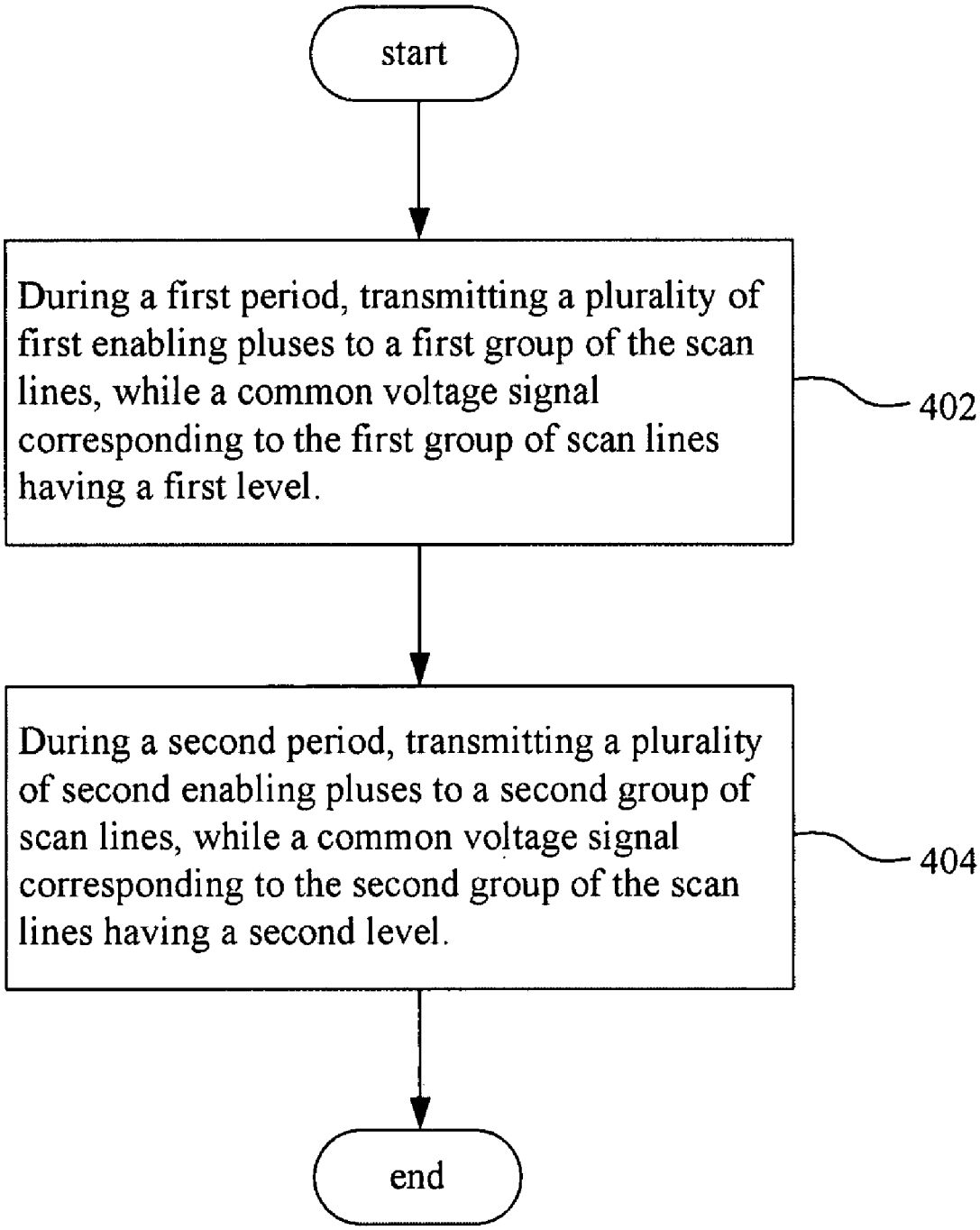
FIG. 4 is a flow chart of the driving method of an LCD according to an embodiment of the invention.
Figure 5:
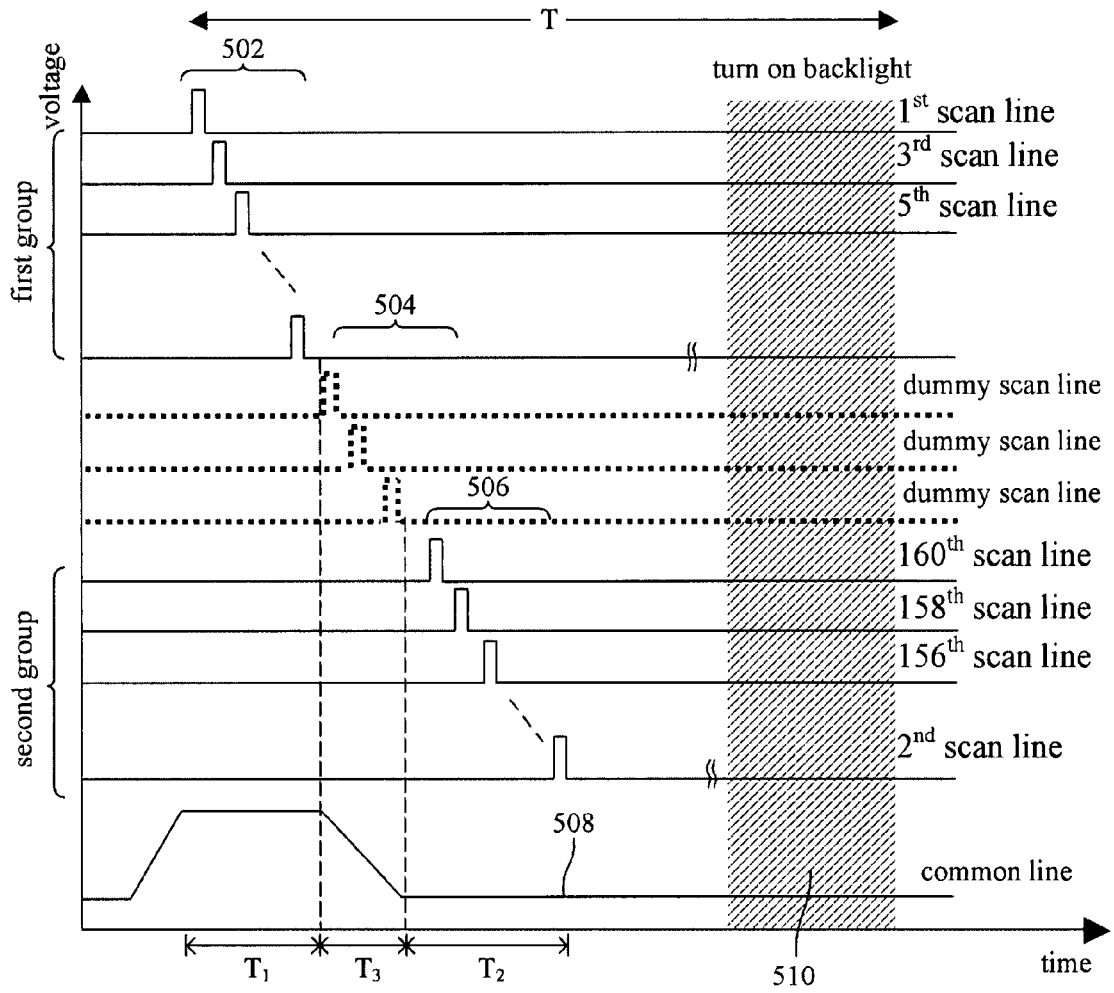
FIG. 5 is a timing chart of signals on the scan lines and common lines of the LCD according to an embodiment of the invention.

Moreover, a driving method for LCD is described in other embodiments of the invention, and an exemplary flow chart is shown in FIG. 4. FIG. 5 is a timing chart of signals on the scan lines and common lines of the LCD according to said embodiment of the invention. Please refer to FIG. 3, FIG. 4 and FIG. 5 with the following description.

During the first period of the predetermined time T, a plurality of first enabling pluses are sequentially transmitted to the first group of scan lines 304*a* (step 402). During the second period T2 of the predetermined time T, a plurality of second enabling pluses are transmitted to the second group of scan lines 304*b* (step 404). Pixel voltages of the pixel units, which connect to the first and second group of scan lines 304*a*, 304*b*, are different in their polarities. In the predetermined time T, a common voltage signal (Vcom) is transmitted to common lines 308, wherein the common voltage signal 508 has different levels during the first period T1 and the second period T2. For example, during the first period T1, the common voltage 508 is at a first level (such as a high level), and during the second period T2, the common voltage 508 is at a second level (such as a low level).

According to the embodiment of the invention, the said predetermined time is a frame time or a sub-frame time. For example, when LCD 300 is driven by the color sequential method, i.e., a complete frame of the LCD 300 is composed of three sub-frames respectively associated with each of three primary colors, the predetermined time is meant to be one sub-frame time, where each sub-frame time is respectively associated with one backlight color. Besides, when LCD 300 is driven with a generally method, e.g., the LCD implements a white light source as backlight, the predetermined time T can directly mean to be a frame time.

Further, the LCD 300 in FIG. 3 can include at least one dummy scan line 310, which is configured to receive at least a dummy enabling pulse 504 (shown on FIG. 5) from the scan driver 306 during the level inversion period T3 of the common voltage signal 508. Also, the level inversion period T3 of the common voltage signal 508 is generally between the first period T1 and the second period T2. Thus, in the polarity inversion period of the pixel voltage of each row of the pixel units 302, one or a plurality of dummy scan lines is configured to receive enabling pluses (i.e. dummy pluses 504) from the scan driver 306. After the voltage of the common voltage signal is stable, other enabling pluses (e.g. second enabling pluses 506) begin to be transmitted to the corresponding scan lines.

According to other embodiments of the invention, the dummy enabling pulse 504 is not necessarily sent to the panel on the layout design, and only needs the a designer of the scan driver 306 to design the drive timing to include the level inversion period T3. Therefore, it is not necessary to implement a physical electronic element (such as the dummy scan line 310). The dummy scan line 310 can be one single scan line or a plurality of scan lines.

If the first group of scan lines 304*a* and the second group of scan lines 304*b* are driven in different timings, the scan driver 306 can be deposited in the middle of the display, and the scan lines 304*a* and 304*b* are connected to the scan driver respectively by the right side and the left side of the scan driver. It should be noted that each element shown in FIG. 3 is meant to illustrate connections between each element for describing characteristics of transmissions of signals, without limiting the physical layout position of each element on the substrate.

In the embodiment shown in FIG. 3, odd scan lines 304*a* are classified as the first group, and even scan lines 304 are classified as a second group. Meanwhile, pixel voltages of the pixel units 302, which connect to the first group of scan lines 304*a* have one polarity, and pixel voltages of the pixel units 302, which connect to the second group of scan lines 304*b* have the another polarity. In other embodiments of the invention, it is not necessarily to divide scan lines according to number characteristics (odd or even) of scan lines, such as if pixel voltages of pixel units connected to two adjacent scan line has the same polarity, scan lines are divided according to the polarity of pixel voltages of the pixel units.

As shown in FIG. 5, in the embodiment, the enabling pluses are sequentially transmitted to the first and second groups of scan lines 304*a*, 304*b* with different scan directions. More specifically, the odd scan lines 304*a* of the first group sequentially receive enabling pluses 502 with the order of the first scan line, the third scan line and the fifth scan etc. Also, the even scan lines 304*b* for the second group sequentially receive enabling pluses 502 with the order of the 160th scan line, the 158th scan line and the 156th scan line etc. In such way, the scan sequence of the enabling pulses begins from up to down and then from down to up in the view of a physical configuration, therefore, the scan sequence of the two groups of scan lines are different. However, according to other embodiments of the invention, the enabling pulses sequentially transmitted to the first and second groups of scan lines 304*a*, 304*b* with the same scan direction, i.e., scan sequences of both the first and second group of scan lines begin from up to down or down to up, thus the scope of the invention is not limited to the aforesaid exemplary.

In addition, after transmissions for both the first and second enabling pulses 502, 504 are finished, a backlight source of the LCD 300 (not shown in FIG. 3) is switched on during the switch-on period of the backlight source 510, such as turning on a primary color or a white light backlight source.

The driving method as described in said embodiments can be executed with a black insertion signal, for example, inserting a black frame with a once-insertion or sequential-insertion method, to enhance the visual performance of the LCD.

Figure 6:
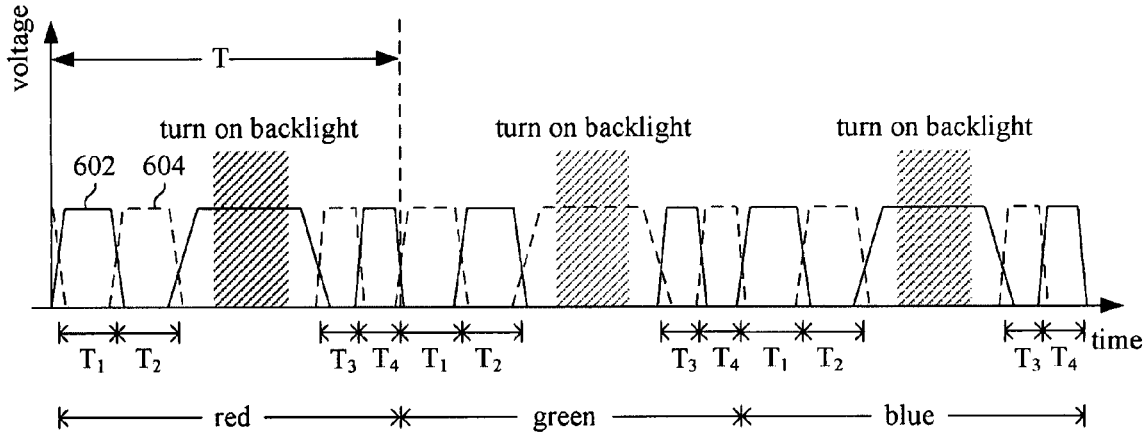
FIG. 6 is a timing chart of signals of an LCD with both the driving method and black insertion method according to an embodiment of the invention.

FIG. 6 is a timing chart of signals of LCD with both the driving method and black insertion method according to an embodiment of the invention. As shown in FIG. 6, each frame time is composed of three sub-frames time T, each sub-frame time corresponds to a backlight color, i.e., only a backlight source of a color is switched on in one sub-frame time T. Each sub-frame time includes a first period T1 and second period T2. It should be noted that the dummy enabling pulse time is obviated for the sake of clarity. However, the obviated dummy enabling pulse time is also referred to the level inversion period T3, which is shown in FIG. 5. The level inversion period T3, during which a voltage level of a common electrode is being inversed, is generally between the first and second period T1, T2. Also, the scope of the invention should not be limited to the embodiments described above.

During the first period T1, a plurality of first enabling pulses are transmitted to the first group of scan lines, and a plurality of second enabling pulses are transmitted to the second group of scan lines during the second period. The pixel voltages of the pixel units connected to the first and second groups of scan lines are different in their polarities, and a common voltage signal 604 have different voltage levels in the first and second period. After the backlight source is switch on, during the first black insertion period T3, a plurality of black insertion signals are sequentially transmitted to pixel units connected to the first group of scan lines. Later, during the second insertion period T4, a plurality of other black insertion signals are sequentially transmitted to pixel units connected to the second group of scan lines, i.e., before pixel units connected to the second group of scan lines begin to receive black insertion signals, pixel units connected to the first group of scan lines sequentially receive black insertion signals to display a black frame.

Beside, in other embodiments of the invention, the black insertion signals are sequentially transmitted to the pixel units connected to the scan lines. For example, in accordance with a scan sequence beginning from up to down, the black insertion signals are sequentially received by pixel units connected to the scan lines, i.e., inserting a black frame.

While the present invention has been described with respect to preferred embodiments thereof, it will be apparent to those skilled in the art that the disclosed invention may be modified in numerous ways and may assume many embodiments other than those specifically described above. Accordingly, it is intended by the appended claims to cover all modifications of the invention that fall within the true spirit and scope of the invention.

What is claimed is:

1. A method of driving a liquid crystal display, comprising:

transmitting a plurality of first enabling pulses to respective scan lines of a first group of scan lines in a first period of a predetermined time, wherein the predetermined time is a frame time or a sub-frame time;

transmitting a plurality of second enabling pulses to respective scan lines of a second group of scan lines in a second period of the predetermined time;

transmitting a common voltage signal to a common line, wherein polarities of pixel voltages of pixel units connected to the scan lines of the first group and of the second group are different, wherein a voltage of the common voltage signal is maintained at a first constant level during the first period, and the voltage of the common voltage signal is maintained at a second constant level during the second period, the first constant level being different from the second constant level, the common voltage signal transiting from the first constant level to the second constant level in an inversion period between the first period and the second period; and transmitting at least one dummy enabling pulse to only at least one dummy scan line during the inversion period of the common voltage signal, without transmitting the dummy enabling pulse to the first group of scan lines and the second group of scan lines, wherein in the inversion period the voltage of the common voltage signal is linearly changed from the first constant level to the second constant level.

2. The method of claim 1, wherein the inversion period of the common voltage signal is between the first period and the second period.

3. The method of claim 1, wherein the predetermined time is a sub-frame time associated with a backlight color.

4. The method of claim 1, wherein at least one dummy enabling pulse is provided during an inversion period of the common voltage signal.

5. The method of claim 1, wherein the first and second enabling pulses are sequentially transmitted to the first and second groups of scan lines respectively with same or different scan directions.

6. The method of claim 1, further comprising switching on a backlight source after transmitting the first and second enabling pulses.

7. The method of claim 6, further comprising transmitting a plurality of black insertion signals to the pixel units connected to the first group of scan lines after switching on the backlight, then transmitting other insertion signals to the pixel units connected to the second group of scan lines.

8. The method of claim 6, further comprising sequentially transmitting black insertion signals to the pixel units connected to the scan lines after switching on the backlight.

9. A liquid crystal display, comprising:

a plurality of pixel units;

a plurality of scan lines, each of the scan lines being respectively connected to one terminal of each of rows of the pixel units, wherein the scan lines are divided into a first group and a second group, and polarities of pixel voltages of the pixel units connected to the scan lines of the first group and of the second group are different;

at least one scan driver configured to transmit a plurality of first enabling pulses to the first group of scan lines in a first period of a predetermined time, and transmit a plurality of second enabling pulses to the second group of scan lines in a second period of the predetermined time, wherein the predetermined time is a frame time or a sub-frame time;

a plurality of common lines, each of the common lines being respectively connected to another terminal of each row of the pixel units, wherein common voltage signals on the common lines are different in polarity during the first period and the second period, wherein a voltage of the common voltage signals is maintained at a first constant level during the first period, and the voltage of the common voltage signals is maintained at a second constant level during the second period, the first constant level being different from the second constant level, and the common voltage signals transiting from the first constant level to the second constant level in an inversion period between the first period and the second period; and at least a dummy scan line, during the inversion period of the common voltage signal, the dummy enabling pulse is transmitted to only the at least a dummy scan line and is not transmitted to the first group of scan lines and the second group of scan lines, a dummy enabling pulse being transmitted to the dummy scan line, wherein in the inversion period the voltage of the common voltage signal is linearly changed from the first constant level to the second constant level.

10. The liquid crystal display of claim 9, wherein the inversion period of the common voltage signal is between the first period and the second period.

11. The liquid crystal display of claim 9, wherein if the LCD is driven by the color sequential method, the predetermined time is a sub-frame time, which is associated with a backlight color.

12. The liquid crystal display of claim 9, wherein the at least one scan driver is configured to output at least one dummy enabling pulse during an inversion period of the common voltage signal.

13. The liquid crystal display of claim 9, wherein the at least one scan driver is configured to sequentially output the first and second enabling pluses to the first and second group of scan lines respectively with same or different scan directions.

14. The liquid crystal display of claim 9, further comprising a backlight source configured to be switched on after transmitting the first and second enabling pulses.

15. The liquid crystal display of claim 14, wherein the at least one scan driver is configured to output a plurality of black insertion signals to the pixel units connected to the first group of scan lines, then output other black insertion signals to the pixel units connected to the second group of scan lines.

16. The liquid crystal display of claim 14, wherein the at least one scan driver is configured to sequentially output a plurality of black insertion signals to the pixel units connected to the scan lines.

* * * * *